US005249737A

United States Patent [19]

Fritz et al.

[11] Patent Number: 5,249,737

[45] Date of Patent: Oct. 5, 1993

[54] METHOD FOR DISPENSING MOISTURE-SENSITIVE UNIT DOSE PACKAGES

[75] Inventors: Barbara L. Fritz, Burnsville; Elizabeth J. Gladfelter, Falcon Heights; Tina O. Outlaw, Inver Grove Heights, all of Minn.

[73] Assignee: Ecolab Inc., St. Paul, Minn.

[21] Appl. No.: 756,458

[22] Filed: Sep. 9, 1991

[51] Int. Cl.[5] ..... B65D 5/76

[52] U.S. Cl. ..... 229/122.1; 221/1; 221/305; 221/306

[58] Field of Search ..... 229/122.1; 221/1, 302, 221/305, 306; 222/527, 528, 531, 534, 535, 541, 547, 564

[56] References Cited

U.S. PATENT DOCUMENTS

| | | | |
|---|---|---|---|
| 1,000,624 | 8/1911 | Pexton . | |
| 1,645,771 | 10/1927 | Pillsbury . | |
| 2,103,960 | 12/1937 | Spiro | 222/531 |
| 2,556,707 | 6/1951 | Rendall et al. | 229/7 |
| 2,831,610 | 4/1958 | Dennie | 222/527 |
| 2,847,153 | 8/1958 | Guyer et al. | 229/17 |
| 3,207,380 | 9/1965 | Hennessey | 229/122.1 |
| 3,536,247 | 10/1970 | Gadiel | 229/122.1 |
| 3,584,768 | 6/1971 | Ascough | 222/528 |
| 4,039,118 | 8/1977 | Kawaoka | 229/122.1 |
| 4,138,052 | 2/1979 | Torigian | 229/17 |
| 4,170,325 | 10/1979 | Pawlowski et al. | 229/122.1 |
| 4,186,866 | 2/1980 | Zicko | 229/17 |
| 4,283,000 | 8/1981 | White | 229/122.1 |
| 4,382,526 | 5/1983 | Stone | 221/305 |
| 4,658,984 | 4/1987 | Brunner | 229/122.1 |
| 4,752,029 | 6/1988 | Buford | 229/122.1 |
| 4,805,765 | 2/1989 | Barrett et al. | 206/45.15 |
| 4,930,681 | 6/1990 | Fultz et al. | 229/114 |
| 5,020,719 | 6/1991 | Roth et al. | 229/122.1 |

FOREIGN PATENT DOCUMENTS 202391 3/1938 Switzerland .

*Primary Examiner*—Gary E. Elkins

*Attorney, Agent, or Firm*—Merchant, Gould, Smith, Edell, Welter & Schmidt

[57] ABSTRACT

A unit dose package dispenser (1) including a drawer (13) and ramp (7) such that unit dose packages are urged through an aperture (10) and into the drawer (13). The ramp (7) is elevated from the bottom region (6) of the container (1) so as to isolate the contents of the container from moisture. A cover (14) formed integrally with the container front wall (4) tends to protect the contents of the drawer (13) from moisture in the surrounding environment.

5 Claims, 3 Drawing Sheets

METHOD FOR DISPENSING MOISTURE-SENSITIVE UNIT DOSE PACKAGES

BACKGROUND OF THE INVENTION

1. Field of the Invention

The present invention relates to a method of and device for dispensing moisture-sensitive unit dose packages. More particularly, the invention is concerned with a method of and a device for storing and dispensing multiple unit dose packages from a central location in a humid or moist environment over a period of one to four weeks.

2. Description of Related Technology

Unit dose packages are packages containing a single premeasured amount of a product which is used in some subsequent process, such as cleaning. In that case, a package of detergent, formed into a tablet, a packet of powder or granules, or perhaps a gelatin material is added to a given amount of water to create a cleaning solution having the appropriate concentration of active cleaning ingredient.

Unit dose packages must be protected from their environment and kept dry in order to be functional. The product must be kept chemically functional and physically usable during its shelf life. If unit dose, moisture-sensitive products absorb an unacceptable amount of moisture, which is typically a very small amount of moisture, the product may not meet functional claims and may not be removable from the package. A unit dose package dispensing device which permits moisture to be introduced into the package may spoil or render useless a large percentage of the package's contents, thus discouraging a customer from buying a similar product in the future. Thus, the marketability of moisture-sensitive unit dose products is protected and enhanced by a storage and dispensing device that preserves a dry environment for the product even when the package is stored in moist surroundings, such as in a kitchen or bathroom.

Moisture can also be introduced into a package by the wet hands of a user attempting to withdraw one of the unit dose containers. Also, since the user's hands may be wet, it is impractical for them to unscrew or manipulate a complicated packaging device in order to obtain the unit dose package, since their hands are slippery and cannot grip a complicated container easily.

Ideally, the container should be made of an inexpensive material, such as cardboard, and should provide some protection for the contents when not in use. The dispenser should not present a serious impediment to obtaining the product when desired so as to waste time or require undue manual dexterity.

Cardboard cartons bearing some similarity to the present invention are known. For example, U.S. Pat. No. 1,000,624, issued to Pexton, discloses a cardboard carton having a trough that extends outwardly from a bottom portion of the carton. The Pexton device, however, does not disclose any method of protecting the contents of the trough from moisture once the trough is extended into a dispensing position.

U.S. Pat. No. 1,645,771, issued to Pillsbury, discloses a combined container and dispenser having an outwardly extending trough near a bottom portion of the container. However, the Pillsbury device does not disclose a method of protecting the contents to be dispensed from moisture when the dispensing trough is extended into its dispensing position.

U.S. Pat. No. 2,556,707, issued to Rendall et al., discloses a convertible shipping carton and self-feeder which contains a plurality of troughs near a bottom region of the container. However, the Rendall et al. disclosure does not teach or suggest a method of protecting the contents of the trough from moisture when the troughs are extended into a dispensing position.

U.S. Pat. No. 2,847,153, issued to Guyer et al., discloses a dispenser box having a lower trough extending across the width of the container. However, Guyer et al. does not disclose a means of protecting the contents of the trough from moisture.

U.S. Pat. No. 4,138,052, issued to Torigian, discloses a multi-layer tray dispensing package, which includes a series of trays stacked vertically, and which may be removed from the dispenser package by removing a portion of the end panel itself, thereby forming a sort of lid. However, the Torigian disclosure assumes that the product to be dispensed is already in a waterproof container, and so the lid formed by the end panel is in a horizontal or higher position whenever a tray is removed far enough to allow the product to be accessible. The horizontal position of the end panel lid does not encourage the efficient runoff of moisture should it impinge the surface of the box, and similarly, the Torigian device requires both the lifting of the lid and the removal of the tray in order to gain access to the product being dispensed.

Finally, U.S. Pat. No. 4,186,866, issued to Zicko, discloses a dispenser container with a cover. Zicko discloses a trough having a hinged lid, but the trough is located at the extreme bottom of the container, thereby providing no protection against a moist surface upon which the container may rest, should water seep through the cardboard bottom. Similarly, Zicko does not anticipate protection from a moist environment insofar as apertures are included in the sides of the box for viewing its contents. Zicko also does not anticipate the need for insertion and withdrawing of the trough itself, since no means is provided for easily gripping the trough lip to withdraw it from the container housing.

SUMMARY OF THE INVENTION

The present invention has been achieved after full consideration of the foregoing problems.

Accordingly, the present invention includes a corrugated carton having a two-piece design including a dispensing feature intended for moisture sensitive unit dose packages. The material used is preferably an "E-FLUTE" corrugated bleached board. The carton has a self-contained drawer that pulls out from the main carton body to become the sole access point for the product to be dispensed. There is an integral awning feature or cover that automatically closes off the drawer opening whenever the product is not being dispensed. The dispensing feature includes a ramp that is located near the bottom of the carton, but elevated some distance above the bottom to provide for protection from moist surfaces. The slanted ramp near, but elevated above, the bottom of the interior of the carton aids in moving the unit dose packages into the drawer residing beneath the awning. Once the package is empty, it may be easily crushed and recycled.

The dispensing feature protects multiple, water-sensitive unit dose packages from moisture by limiting the amount of product exposed to the outside environment at any one time. This is accomplished first by limiting the number of unit dose packages present in the drawer, and secondly by using an integral awning that covers the product being held in the drawer between dispensing events.

Since the drawer feature is located near the bottom of the container and is the only access point, hand access is limited. With water-sensitive unit dose products, it is critical that they be protected from wet hands. In the present invention, since only a partial length of a human finger can gain access into the drawer, it reduces the chance that a unit dose product, other than the one being removed at the time, will get wet. Also, since the user must reach in from the bottom, rather than the top, moisture is kept from dripping down into the entire carton of unit dose product. Furthermore, the slanted ramp near the bottom of the carton moves unit dose packages forward into the dispensing drawer while limiting hand access into the remainder of the package.

Finally, the package is easy to use since the awning may be lifted by one hand and the unit dose package removed with the same hand as needed.

DETAILED DESCRIPTION OF THE PREFERRED EMBODIMENTS

Figure 1:
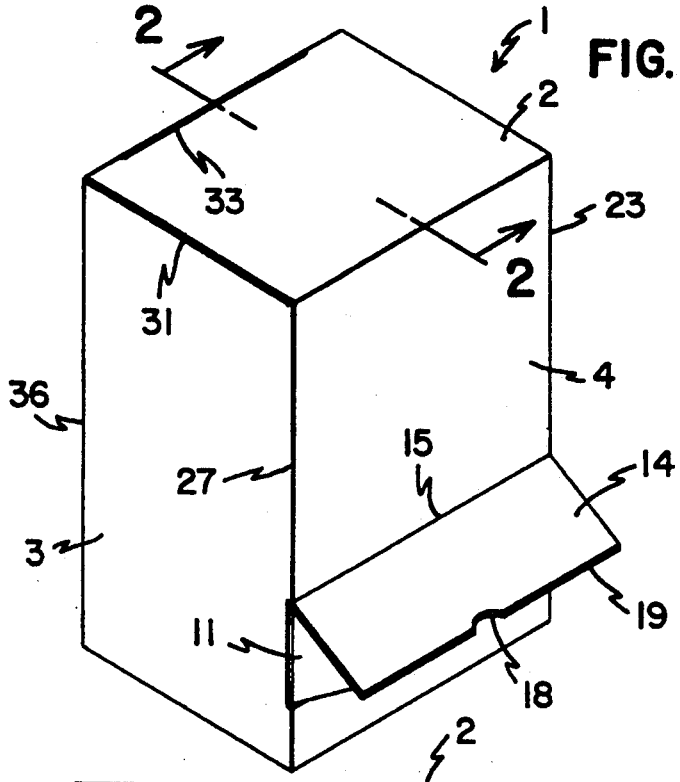
FIG. 1 is a perspective view showing a dispensing apparatus constructed according to the principles of the present invention.

Referring to FIG. 1, an apparatus constructed in accordance with the principles of the present invention is shown generally at 1. The apparatus is formed generally in the shape of a rectangular solid, and includes cover 2, left side wall 3, and front surface 4.

Figure 2:
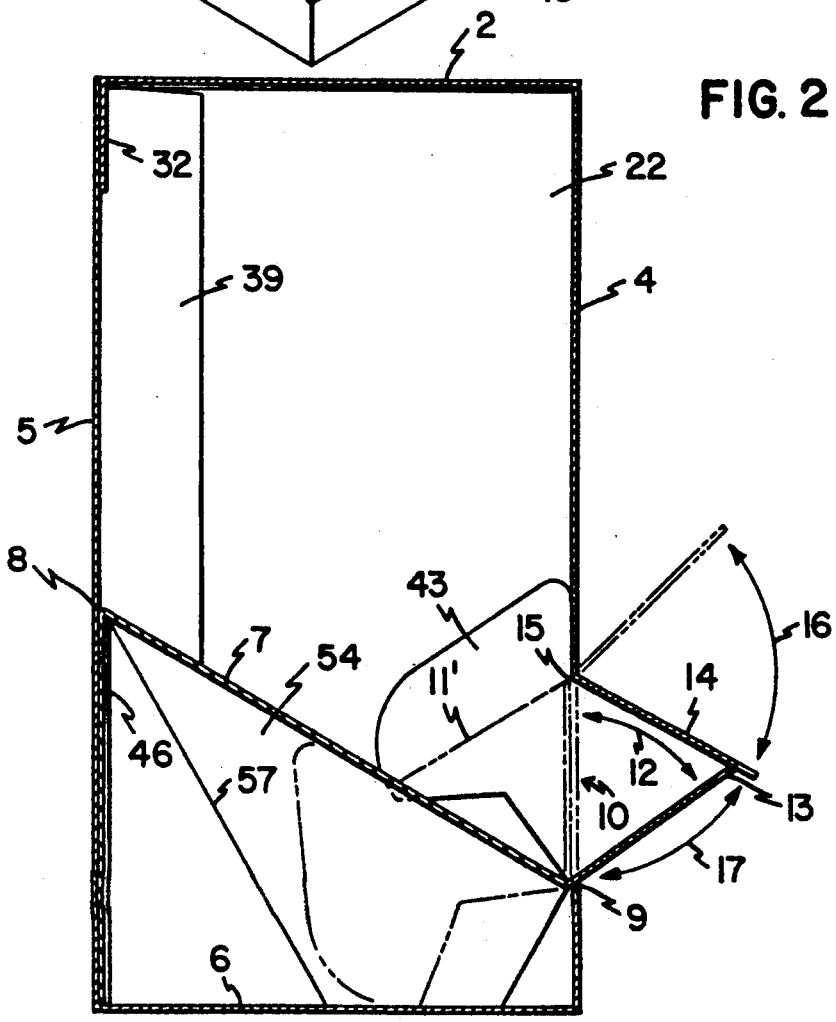
FIG. 2 is a sectional view, taken along lines 2—2, of the apparatus depicted in FIG. 1.

As may be seen in FIG. 2, the dispenser 1 also includes a rear wall 5 and a bottom surface 6.

Placed within the box can be a variety of unit dose items, such as tablets, pellets or the like (not shown). Typically, such unit dose packages are water-soluble and must be protected from moisture until the time of intended use. When protected from moisture, the shelf life of the unit dose packages may be typically on the order of months.

Within container 1 is a ramp 7 which is supported between a first region 8 of rear wall 5 and a relatively lower die cut second region 9 of front wall 4. Unit dose packages coming into contact with the ramp will therefore be urged in a direction towards the front wall 4 of container 1.

Immediately above region 9 of front wall 4 is an opening 10 within front wall 4, typically extending across the entire width of front wall 4 and being of sufficient height to permit access to the unit dose packages within container 1.

Pivotably mounted within box 1 is a drawer 13 including side wall 11 which pivots at its base along die cut region 9 of front wall 4, through an angular displacement defined by angle 12. Angle 12 must be chosen to be large enough so that access to the unit dose packages within container 1 is possible, yet need be no larger than is necessary to permit the retrieval of one or two of the unit dose packages at one time.

When drawer 13 is fully extended from container 1, the drawer 13 assumes an angle of between approximately 30° and 70° with relation to front wall 4. When drawer 13 is fully withdrawn or closed within container 1, drawer 13 is substantially flush with front wall 4 of container 1. Side wall 11 is shown in its withdrawn position as 11' in FIG. 2.

Cover 14 pivots about score line 15 of front wall 4, permitting cover 14 to travel through an angular displacement at least equal to angle 16, the upward movement of cover 14 being restrained by the position of wall 4 and the downward movement of cover 14 being restrained by the position of drawer 13. When drawer 13 and its associated side wall 11 is withdrawn to position 11', cover 14 may travel through the additional angular displacement of angle 17, thereby permitting cover 14 to be substantially flush with front wall 4. The drawer 13 may have perforations (not shown) in a bottom region in order to facilitate drainage.

Figure 4:
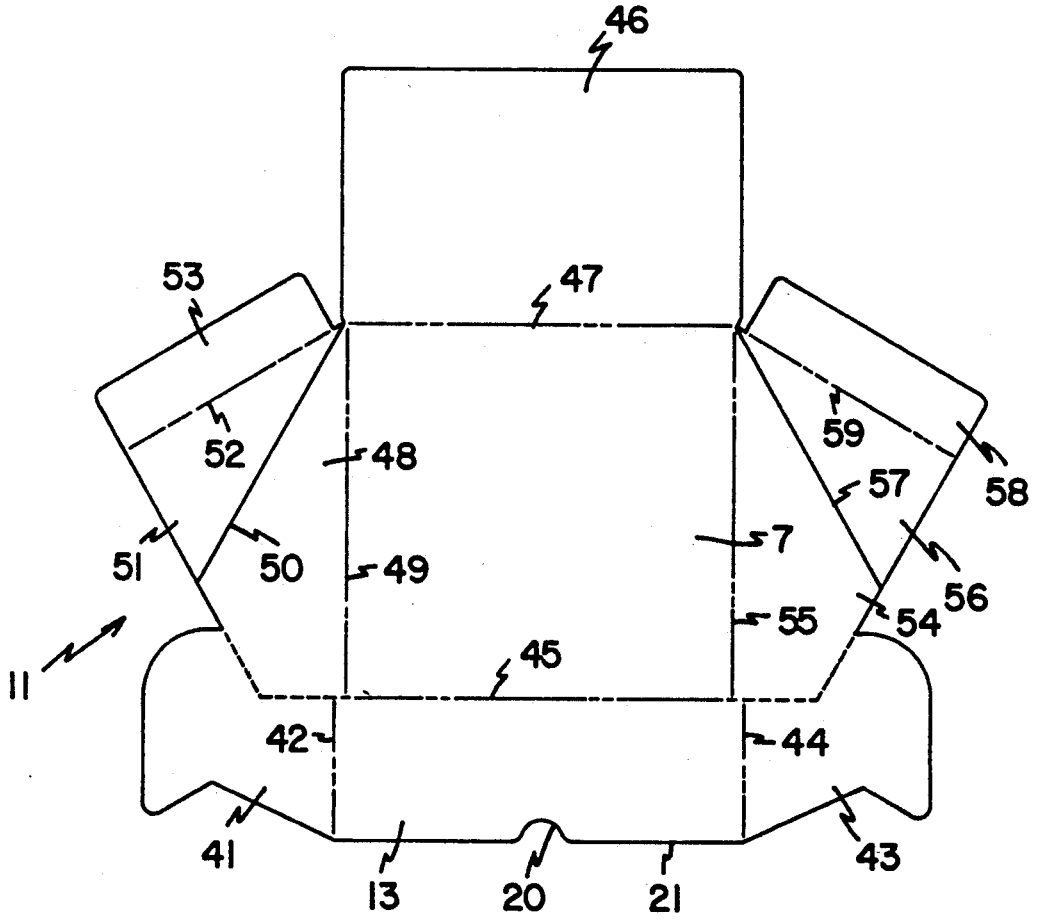
FIG. 4 is a plan view of a cut and scored blank of paperboard or the like for forming the pivoting drawer contained in the apparatus depicted in FIG. 1.

In order to facilitate manipulation of cover 14, indentation 18 is formed along leading edge 19 of cover 14. Similarly, as shown in FIG. 4, indentation 20 is formed within leading edge 21 of drawer 13 in order to facilitate inserting and withdrawing of trough 11 with relation to the interior of container 1.

As shown in FIGS. 1 and 2, the cover 14 is folded such that gravity pulls it in a downward direction. The cover 14 is supported by the drawer 13 in a manner which closes off the drawer opening. Thus the cover 14, unless it is lifted by the user, automatically is positioned so as to substantially close off the drawer opening.

Figure 3:
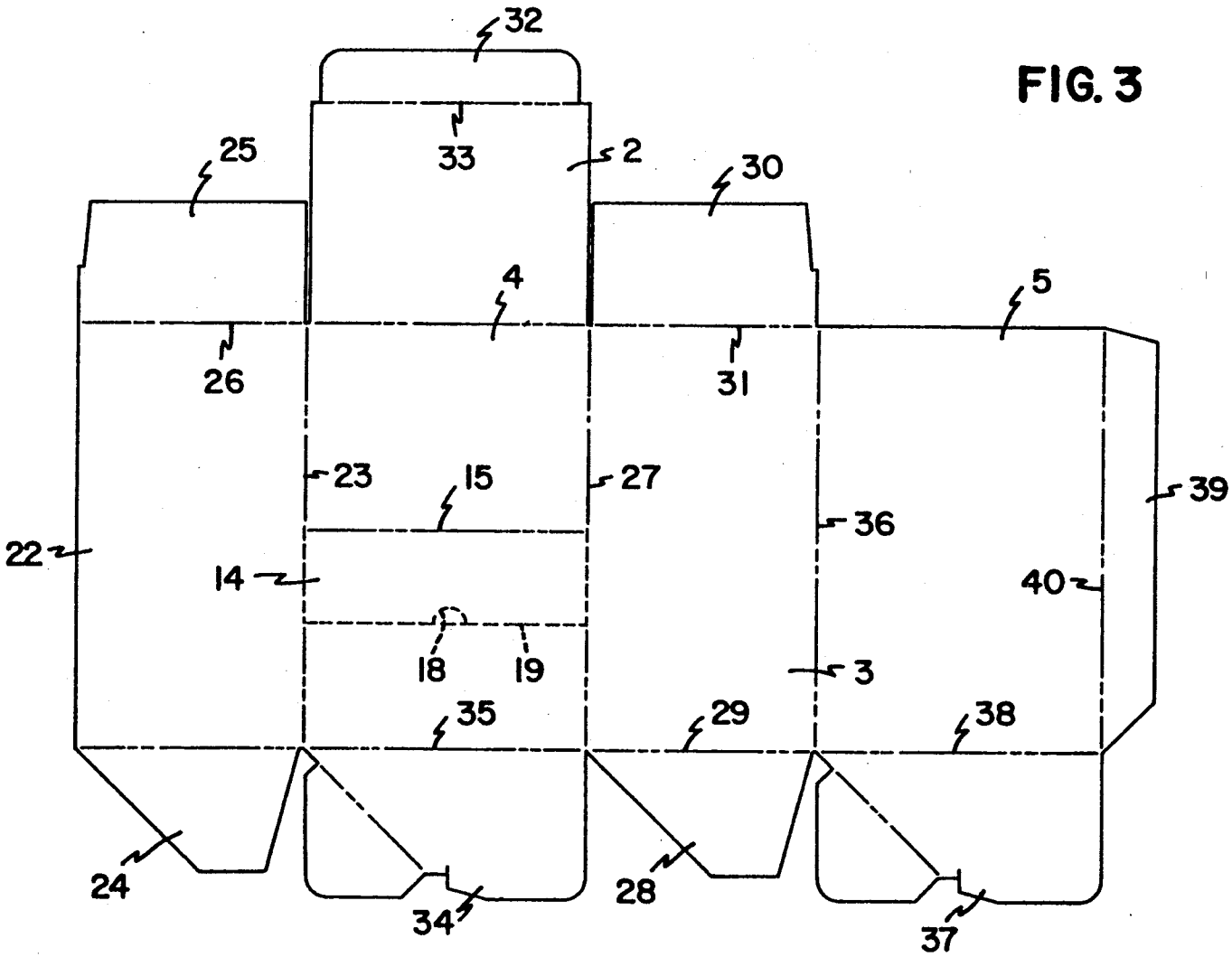
FIG. 3 is a plan view of a cut and scored blank of cardboard or the like for forming the apparatus depicted in FIG. 1.

The actual construction of container 1 may best be envisioned by reference to FIG. 3. Side wall 22 is joined to front wall 4 along score line 23 while bottom flap 24 forms a portion of bottom member 6. Upper flap 25 is folded along score line 26 to reside beneath top 2.

Similarly, side flap 3 joins front wall 4 along score line 27, while bottom flap 28 is folded along score line 29 to form part of bottom member 6. Upper flap 30 is folded along score line 31 to reside opposite upper flap 25 and beneath cover 2. Upper flaps 25 and 30 are held in place beneath cover 2 by means of flap 32 which is folded along score line 33.

Lower flap 34 folds along score line 35 to form a portion of bottom member 6.

Finally, rear wall 5 is folded into place along score line 36, while lower flap 37 is folded along score line 38 to form the remainder of bottom portion 6. Side flap 39 is folded along score line 40 to be secured to side wall 22 by a suitable adhesive, staples or the like.

Typically, the container 1 is constructed of an "E-FLUTE," corrugated bleached board, but may be constructed of any material providing sufficient rigidity and resistance to moisture. In the case of some paperboard materials, the interior of the container 1 may be coated or lined with a plastic or other moisture barrier material (not shown), and a desiccant material (not shown) may be placed within the interior of container 1.

Referring to FIG. 4, the construction of the drawer 13 may be visualized. The drawer 13 is formed integrally with left side member 41, which thereafter becomes side wall 11 along score line 42 and is formed integrally with right side member 43 along score line 44. Ramp 7 is integrally formed with drawer 13 along score line 45. To the rear of ramp 7 is vertical support member 46 which joins ramp 7 along score line 47.

Left side panel 48 is formed integrally with ramp 7 along score line 49, with left side panel 48 being bent along split score line 50. Adjoining split score line 50 is support panel 51 which is bent along score line 52 to create vertical support flap 53, which is glued or otherwise fastened so as to overlay a portion of vertical support member 46.

Similarly, right side panel 54 adjoins ramp 7 along score line 55 and adjoins panel 56 along split score line 57. Panel 56 is integrally formed with vertical support flap 58 along score line 59, vertical support flap 58 being glued or otherwise fastened so as to overlie a portion of vertical support member 46. As with the rest of the container, the drawer structure 13 may be constructed of any suitably rigid material such as paperboard, cardboard, plastic, metal or the like. In the case of potentially water permeable materials, the drawer structure 13 may be coated with a suitable water impervious material, plastic liner or the like.

Other embodiments and modifications of this invention will suggest themselves to those skilled in the art, and all of these that come within the spirit of this invention are included within its scope as defined by the appended claims.

I claim:

1. A method of dispensing and storing moisture-sensitive packages from a filled container, comprising the steps of:

(a) urging at least some of the packages toward a substantially covered exit aperture which is formed within the container by supporting said packages upon an inclined ramp which is spaced above a bottom surface of the container and which has a lower portion proximate said aperture;

(b) pivoting a wall which is formed integrally with the ramp, the wall substantially completely obstructing the aperture in a first position and permitting access through the aperture to the packages within the container when the wall is pivoted to a second position;

(c) lifting a cover so as to permit access through the aperture into the container, wherein the cover is formed integrally with a surface of the container which contains the aperture, the cover being capable of substantially obstructing the aperture; and (d) releasing the cover so as to substantially cover the aperture automatically subsequent to removal of one of said packages from the container through the aperture.

2. The method of claim 1, wherein a region where the wall and the ramp are joined is perforated, thereby permitting moisture reaching the region to drain through the perforations and away from the packages.

3. The method of claim 1, wherein an edge of the cover includes an indentation, thereby facilitating lifting of the cover.

4. The method of claim 3, wherein a leading edge of the wall includes an indentation, thereby facilitating insertion and withdrawal of the wall.

5. The method of claim 1, further including the step of lifting an upper flap of said container to place a plurality of packages within said container.

* * * * *